US011352915B2

(12) United States Patent
Takeuchi

(10) Patent No.: US 11,352,915 B2
(45) Date of Patent: Jun. 7, 2022

(54) CYLINDER HEAD

(71) Applicant: TOYOTA JIDOSHA KABUSHIKI KAISHA, Toyota (JP)

(72) Inventor: Hirotaka Takeuchi, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 124 days.

(21) Appl. No.: 16/702,643

(22) Filed: Dec. 4, 2019

(65) Prior Publication Data

US 2020/0182101 A1 Jun. 11, 2020

(30) Foreign Application Priority Data

Dec. 11, 2018 (JP) ..... JP2018-231548

(51) Int. Cl.

| | |
|---|---|
| ***F01L 1/24*** | (2006.01) |
| ***F01L 1/18*** | (2006.01) |
| ***F01L 1/053*** | (2006.01) |
| ***F02F 1/24*** | (2006.01) |
| ***F02M 61/14*** | (2006.01) |

(52) U.S. Cl.

CPC ..... *F01L 1/2405* (2013.01); *F01L 1/053* (2013.01); *F01L 1/181* (2013.01); *F02F 1/242* (2013.01); *F02M 61/14* (2013.01); *F01L 2001/2444* (2013.01)

(58) Field of Classification Search

CPC ..... F01L 1/2405; F01L 1/053; F01L 1/181; F01L 2001/2444; F02F 1/242; F02M 61/14

USPC ..... 123/470

See application file for complete search history.

(56) References Cited

U.S. PATENT DOCUMENTS

| | | | | |
|---|---|---|---|---|
| 4,729,349 A * | 3/1988 | Sonoda | F01M 11/02 | 123/90.34 |
| 5,031,586 A * | 7/1991 | Masuda | F01L 1/2405 | 123/90.35 |
| 5,979,383 A * | 11/1999 | Faville | F01L 1/185 | 123/90.43 |
| 6,276,320 B1 * | 8/2001 | Fujii | F01L 1/267 | 123/90.6 |

(Continued)

FOREIGN PATENT DOCUMENTS

| | | |
|---|---|---|
| DE | 24 34 831 A1 | 1/1976 |
| JP | 59-155517 A | 9/1984 |

(Continued)

*Primary Examiner* — Logan M Kraft
*Assistant Examiner* — John D Bailey
(74) *Attorney, Agent, or Firm* — Oblon, McClelland, Maier & Neustadt, L.L.P.

(57) ABSTRACT

A cylinder head includes a hydraulic lash adjuster attachment portion provided with a hydraulic lash adjuster bore in which a hydraulic lash adjuster is inserted; a main oil provided at a position away from the hydraulic lash adjuster bore; a connection oil passage which connects the hydraulic lash adjuster bore and the main oil passage; and a side wall that defines a radially outer portion of the hydraulic lash adjuster bore. The side wall includes a first side wall portion and a second side wall portion that is positioned closer to an opening of the hydraulic lash adjuster bore than the first side wall portion is. A thickness of the second side wall portion is greater than a thickness of the first side wall portion.

6 Claims, 4 Drawing Sheets

(56) References Cited

U.S. PATENT DOCUMENTS 6,505,589 B1* 1/2003 Hayman ..... F01L 1/146 123/90.23
6,505,592 B1* 1/2003 Hayman ..... F01L 1/022 123/90.55
10,323,550 B1* 6/2019 Fluharty ..... F01L 1/053
2003/0094155 A1* 5/2003 Shimoyama et al. .... F01L 1/46 123/188.2
2007/0095312 A1* 5/2007 Vanderpoel ..... F01L 1/047 123/90.15
2007/0215081 A1* 9/2007 Frincke ..... F01L 1/04 123/90.27
2008/0210208 A1* 9/2008 Tateno ..... F02D 41/0002 123/90.15
2009/0000585 A1* 1/2009 Sasaki ..... F01L 1/052 123/90.45
2009/0078230 A1* 3/2009 Imazato ..... F01L 1/185 123/196 M
2012/0210975 A1* 8/2012 Borean ..... F01L 9/12 123/294
2014/0202407 A1* 7/2014 Miyamoto ..... F01L 1/3442 123/90.15
2015/0090206 A1* 4/2015 Tani ..... F01L 1/04 123/90.12
2015/0308301 A1* 10/2015 McConville ..... F01L 13/0005 123/90.15
2015/0354418 A1* 12/2015 Jo ..... F01L 1/267 123/90.43
2016/0123198 A1* 5/2016 Beyer ..... F01L 1/46 123/90.27
2016/0312666 A1* 10/2016 Manther ..... F01L 1/2405
2016/0319706 A1* 11/2016 McConville ..... F01L 1/2405
2017/0022856 A1* 1/2017 Hara ..... F01L 9/16
2017/0074128 A1* 3/2017 Zurface ..... F01L 1/185
2018/0080350 A1* 3/2018 Nair ..... F01L 1/182
2018/0179922 A1 6/2018 Takehana et al.
2019/0010835 A1* 1/2019 McCarthy, Jr. ..... F01L 13/06
2019/0234248 A1* 8/2019 Genise ..... F01L 1/053
2019/0277204 A1* 9/2019 Miyashita ..... F01L 13/08
2019/0331032 A1* 10/2019 McConville ..... F02D 13/06
2019/0331048 A1* 10/2019 Ulrey ..... F02D 41/2464
2020/0056514 A1* 2/2020 Ting ..... F01L 1/265
2020/0271024 A1* 8/2020 Stretch ..... F01L 1/185

FOREIGN PATENT DOCUMENTS

JP H03-115712 A 5/1991
JP 9-236043 A 9/1997
JP 2018-44508 A 3/2018
JP 2018-105263 A 7/2018

* cited by examiner

CYLINDER HEAD

INCORPORATION BY REFERENCE

The disclosure of Japanese Patent Application No. 2018-231548 filed on Dec. 11, 2018 including the specification, drawings and abstract is incorporated herein by reference in its entirety.

BACKGROUND

1. Technical Field

The disclosure relates to a cylinder head of an internal combustion engine.

2. Description of Related Art

Japanese Patent Application Publication No. 9-236043 (JP 9-236043 A) describes an internal combustion engine in which a direct injection injector injecting fuel into a combustion chamber is disposed closer to a cylinder block than an intake port is. The internal combustion engine includes a valve drive mechanism that includes a hydraulic lash adjuster (HLA) and a rocker arm. The lash adjuster is supported by a cylinder head of the internal combustion engine. In the cylinder head, an oil passage, through which oil is supplied to the lash adjuster, is provided adjacent to the lash adjuster. Such an oil passage is formed to extend in an axial direction of a camshaft.

In the valve drive mechanism, a load is applied to the lash adjuster due to operation of a valve. In the cylinder head described in JP 9-236043 A, the oil passage, which is disposed adjacent to the lash adjuster, is located in a direction in which stress acts, the stress being generated by the load applied to the lash adjuster.

SUMMARY

As described above, when the oil passage is provided adjacent to the lash adjuster in the direction in which the stress acts, strength against the stress, which acts when the load is applied to the lash adjuster, is increased, and thus the strength for supporting the lash adjuster is easily obtained. Meanwhile, as the internal combustion engine that includes the direct injection injector, there is an internal combustion engine in which the direct injection injector is disposed such that an injection is positioned in a central portion of the combustion chamber. In such an internal combustion engine, for example, in the case where the direct injection injector and an ignition plug are disposed between an intake valve and an exhaust valve, it is difficult to form the oil passage, which extends in the axial direction of the camshaft, adjacent to the lash adjuster.

Accordingly, in the case where the oil passage, which extends in the axial direction of the camshaft, and the lash adjuster need to be disposed away from each other, it is necessary to ensure the strength against the stress that is generated by the load applied to the lash adjuster, by employing another configuration.

A cylinder head according to an aspect of the disclosure is configured to be provided in an internal combustion engine that includes at least one valve drive mechanism including a hydraulic lash adjuster and a rocker arm, each of the at least one valve drive mechanism being configured to transmit rotation of a camshaft to drive an intake valve or an exhaust valve. The cylinder head includes a hydraulic lash adjuster attachment portion provided with a hydraulic lash adjuster bore in which the hydraulic lash adjuster is inserted; a main oil passage through which oil flows, the main oil passage being provided at a position away from the hydraulic lash adjuster bore in a direction that crosses an axial direction of the camshaft, and the main oil passage extending in the axial direction of the camshaft; a connection oil passage which connects the hydraulic lash adjuster bore and the main oil passage, and through which the oil is supplied to the hydraulic lash adjuster; and a side wall that defines a radially outer portion of the hydraulic lash adjuster bore in the hydraulic lash adjuster attachment portion. The side wall includes a first side wall portion and a second side wall portion that is positioned closer to an opening of the hydraulic lash adjuster bore than the first side wall portion is. A thickness of the second side wall portion is greater than a thickness of the first side wall portion.

In the above configuration, the side wall is reinforced by providing the second side wall portion that partially increases the thickness of the side wall defining the hydraulic lash adjuster bore. In the cylinder head in which the main oil passage extending in the axial direction of the camshaft is positioned away from the hydraulic lash adjuster bore, it is possible to ensure required strength of a portion around the hydraulic lash adjuster bore by reinforcing the side wall defining the hydraulic lash adjuster bore with the use of the second side wall portion. While the thickness of the side wall is increased by the second side wall portion, the first side wall portion, which is thinner than the second side wall portion, is provided at a portion close to (i.e., a portion on the side of) a bottom of the hydraulic lash adjuster bore where stress generated by a load applied to the lash adjuster is less likely to act. Thickening of the entire side wall defining the hydraulic lash adjuster bore leads to an increase in weight. Meanwhile, in the above configuration, the portion that requires strength is thickened. Thus, it is possible to reduce a weight increase. That is, it is possible to reduce the weight increase while ensuring the strength required to support the lash adjuster against the stress, which is generated by the load applied to the lash adjuster.

In the cylinder head according to the above aspect, in the side wall defining the hydraulic lash adjuster bore, at least a part of the second side wall portion that is thicker than the first side wall portion may be included in an area that is closer to the opening than a center of the hydraulic lash adjuster bore in a depth direction is.

With the above configuration, it is possible to ensure the strength of the portion that is closer to the opening than the center of the hydraulic lash adjuster bore in the depth direction is, that is, the portion where the stress, which is generated by the load applied to the lash adjuster, is likely to act, with the use of the second side wall portion that increases the thickness of the side wall defining the hydraulic lash adjuster bore.

In the cylinder head according to the above aspect, in the side wall defining the hydraulic lash adjuster bore, in an area that is closer to a bottom of the hydraulic lash adjuster bore than the center of the hydraulic lash adjuster bore in the depth direction is, a proportion of the first side wall portion may be greater than a proportion of the second side wall portion.

In the above configuration, in the area that is closer to the bottom of the hydraulic lash adjuster bore than the center of the hydraulic lash adjuster bore in the depth direction is, the proportion of the first side wall portion is great while the proportion of the second side wall portion, which is thicker than the first side wall portion, is small. Thus, it is possible to reduce the weight increase of a portion where the stress, which is generated by the load applied to the lash adjuster, is less likely to act.

In the cylinder head according to the above aspect, an ignition plug and a direct injection injector may be disposed between the intake valve and the exhaust valve such that an injection hole of the direct injection injector is positioned in a central portion of a combustion chamber.

The internal combustion engine of a center injection type, in which the direct injection injector is disposed between the intake valve and the exhaust valve, has a restriction on arrangement of the main oil passage that extends in the axial direction of the camshaft. In the internal combustion engine of the center injection type, it is particularly effective to ensure the strength of the side wall of the hydraulic lash adjuster bore, with the use of the second side wall portion.

The cylinder head according to the above aspect may be configured to be provided in the internal combustion engine in which the two exhaust valves are provided in each combustion chamber, and the valve drive mechanisms are respectively provided to drive the exhaust valves; an ignition plug may be disposed at a position between the hydraulic lash adjuster attachment portions corresponding to the hydraulic lash adjusters provided in the valve drive mechanisms; each of the hydraulic lash adjuster attachment portions may be provided with a recess portion that is recessed in accordance with a shape of the ignition plug; and the thickness of the second side wall portion may be greater than the thickness of the first side wall portion in the side wall excluding the recess portion.

Even in the case where the recess portion, which is recessed in accordance with the shape of the ignition plug, is provided in order to avoid the interference between the ignition plug and the hydraulic lash adjuster attachment portion, it is possible to ensure the required strength of the side wall defining the hydraulic lash adjuster bore, because the thickness of the second side wall portion is greater than the thickness of the first side wall portion in the side wall excluding the recess portion.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
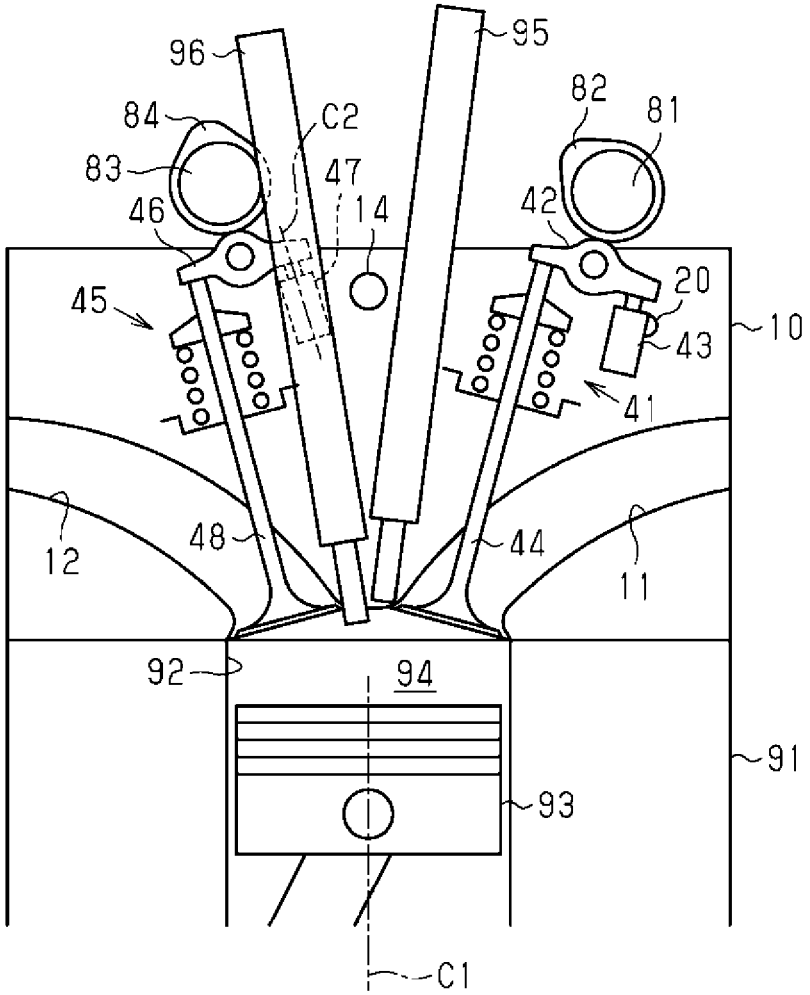
FIG. 1 is a schematic view of an internal combustion engine that includes a cylinder head according to an embodiment.

A description will be provided on a cylinder head according to an embodiment with reference to FIG. 1 to FIG. 4. FIG. 1 illustrates an internal combustion engine that includes a cylinder head 10. The internal combustion engine includes a cylinder block 91 in which cylinder bores 92 are provided. The internal combustion engine is an inline four-cylinder internal combustion engine. In the cylinder block 91, the four cylinder bores 92 are provided. A piston 93 that can reciprocate in an interlocking manner with rotation of a crankshaft is accommodated in the cylinder bore 92. The cylinder head 10 is attached to an upper portion of the cylinder block 91. The internal combustion engine includes a combustion chamber 94 that is defined by the cylinder bore 92, the piston 93, and the cylinder head 10.

The cylinder head 10 is provided with an intake port 11, through which intake air is delivered into the combustion chamber 94. The cylinder head 10 is provided with an exhaust port 12, from which air-fuel mixture combusted in the combustion chamber 94 is discharged as exhaust gas. The cylinder head 10 is provided with intake valves 44 each of which allows and interrupts communication between the intake port 11 and the combustion chamber 94. The cylinder head 10 is provided with exhaust valves 48 each of which allows and interrupts communication between the combustion chamber 94 and the exhaust port 12. Two intake valves 44 and two exhaust valves 48 are provided in each of the combustion chambers 94. That is, the cylinder head 10 is provided with four pairs of the intake valves 44 (i.e., eight intake valves 44 in total). Similarly, the cylinder head 10 is provided with four pairs of the exhaust valves 48 (i.e., eight exhaust valves 48 in total).

The internal combustion engine includes an ignition plug 96. The ignition plug 96 is disposed between the intake valve 44 and the exhaust valve 48 and is attached to the cylinder head 10 such that an electrode thereof is exposed from a central portion of the combustion chamber 94.

The internal combustion engine includes a direct injection injector (an in-cylinder injection injector) 95 that injects fuel into the combustion chamber 94. The direct injection injector 95 is disposed between the intake valve 44 and the exhaust valve 48 and is attached to the cylinder head 10 such that an injection hole thereof is positioned in the central portion of the combustion chamber 94.

The internal combustion engine includes intake-side valve drive mechanisms 41 and exhaust-side valve drive mechanisms 45. The intake-side valve drive mechanisms 41 are respectively provided for the intake valves 44. The exhaust-side valve drive mechanisms 45 are respectively provided for the exhaust valves 48.

An intake-side camshaft 81, which drives the intake valves 44, and an exhaust-side camshaft 83, which drives the exhaust valves 48, are attached to the cylinder head 10. The intake-side valve drive mechanism 41 includes an intake-side rocker arm 42 that is pressed by an intake-side cam 82 provided on the intake-side camshaft 81. One end of the intake-side rocker arm 42 is supported by the intake valve 44, and the other end on an opposite side of a roller from the one end is supported by an intake-side lash adjuster 43. The intake-side cam 82 contacts the roller. When the intake valve 44 is opened, a load is applied to the intake-side lash adjuster 43 via the intake-side rocker arm 42 pressed by the intake-side cam 82.

The exhaust-side valve drive mechanism 45 includes an exhaust-side rocker arm 46 that is pressed by an exhaust-side cam 84 provided on the exhaust-side camshaft 83. One end of the exhaust-side rocker arm 46 is supported by the exhaust valve 48, and the other end on an opposite of a roller from the one end is supported by an exhaust-side lash adjuster 47. The exhaust-side cam 84 contacts the roller. When the exhaust valve 48 is opened, a load is applied to the exhaust-side lash adjuster 47 via the exhaust-side rocker arm 46 pressed by the exhaust-side cam 84.

Each of the intake-side lash adjuster 43 and the exhaust-side lash adjuster 47 includes a plunger that contacts the rocker arm; and a bottomed tubular body that accommodates the plunger. The plunger is accommodated in the body so as to be displaceable along an axial direction of the body. A projected length of the plunger from the body is adjusted by a hydraulic pressure of oil that is supplied into the body.

The exhaust-side lash adjuster 47 is supported by the cylinder head 10 in a state where a projected direction of the plunger (i.e., a direction in which the plunger projects) is inclined with respect to a center axis C1 of the cylinder bore 92. FIG. 1 illustrates a center axis C2 of the body of the exhaust-side lash adjuster 47.

The cylinder head 10 is provided with a main oil passage 14 as an oil channel through which the oil is supplied to the exhaust-side lash adjuster 47. The main oil passage 14 is formed at a position away from the exhaust-side lash adjuster 47 in a direction that crosses an axial direction of the exhaust-side camshaft 83. The main oil passage 14 extends between the direct injection injector 95 and the ignition plug 96 and extends in the axial direction of the exhaust-side camshaft 83. The cylinder head 10 is provided with an intake-side oil passage 20 as an oil channel through which the oil is supplied to the intake-side lash adjuster 43. The intake-side oil passage 20 is formed at a position adjacent to the intake-side lash adjuster 43. The intake-side oil passage 20 extends in the axial direction of the exhaust-side camshaft 83 and is disposed in parallel with the main oil passage 14.

Figure 2:
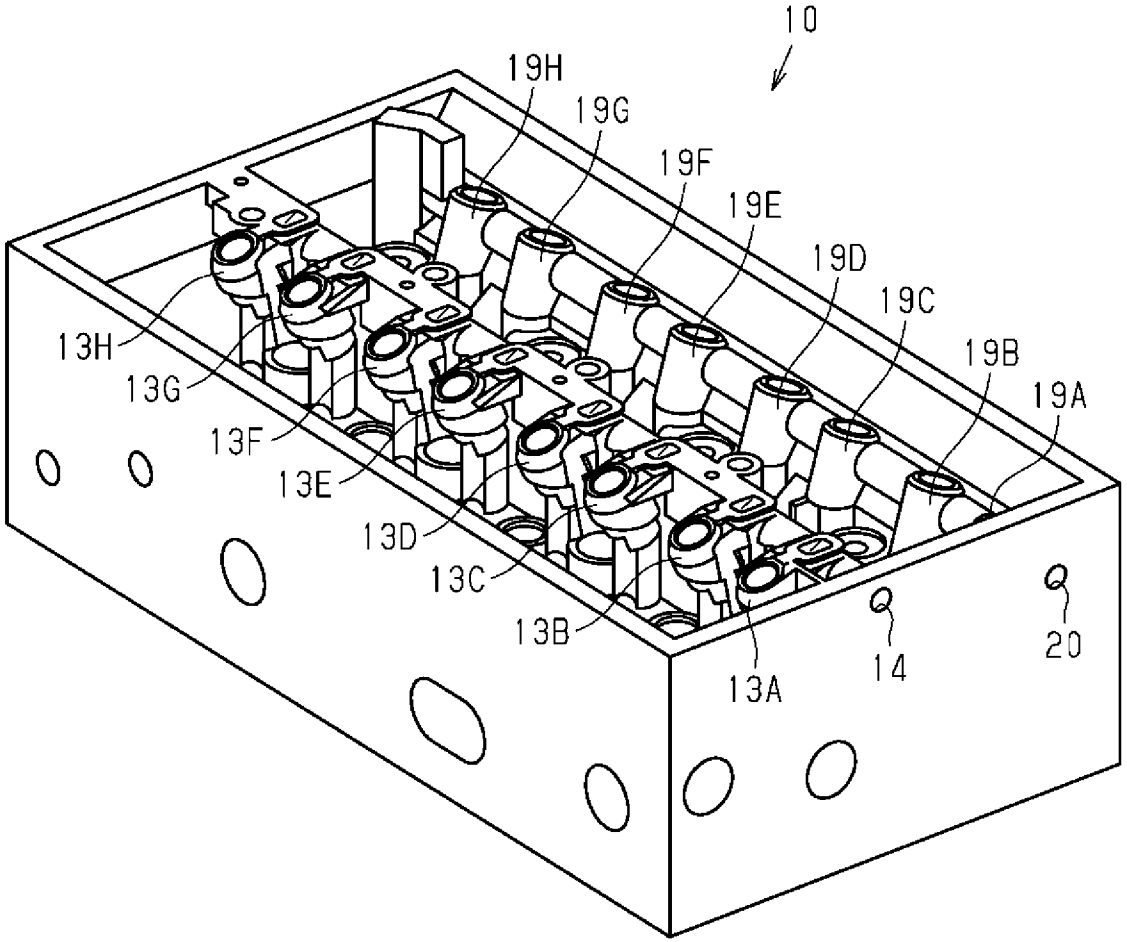
FIG. 2 is a perspective view of the cylinder head according to the embodiment.

As illustrated in FIG. 2, the cylinder head 10 is provided with a first HLA attachment portion 13A to an eighth HLA attachment portion 13H, each of which supports the exhaust-side lash adjuster 47. The HLA attachment portions 13A to 13H are aligned in an extending direction of the main oil passage 14. The first HLA attachment portion 13A and the second HLA attachment portion 13B are disposed as a pair of the HLA attachment portions corresponding to the combustion chamber 94. Similarly, a pair of the third HLA attachment portion 13C and the fourth HLA attachment portion 13D, a pair of the fifth HLA attachment portion 13E and the sixth HLA attachment portion 13F, and a pair of the seventh HLA attachment portion 13G and the eighth HLA attachment portion 13H are each disposed as the pair of the HLA attachment portions corresponding to the combustion chamber 94.

The cylinder head 10 is also provided with intake-side HLA attachment portions 19A to 19H, each of which supports the intake-side lash adjuster 43. The intake-side HLA attachment portions 19A to 19H are aligned in an extending direction of the intake-side oil passage 20. The intake-side HLA attachment portions 19A to 19H are formed adjacent to the intake-side oil passage 20.

Figure 3:
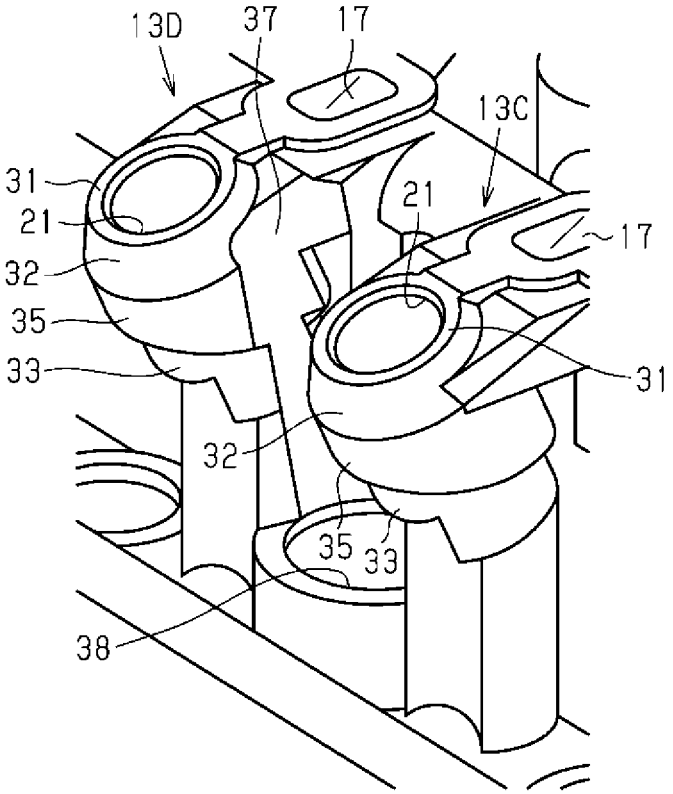
FIG. 3 is an enlarged view of HLA attachment portions in the cylinder head according to the embodiment and an area around the HLA attachment portions.
Figure 4:
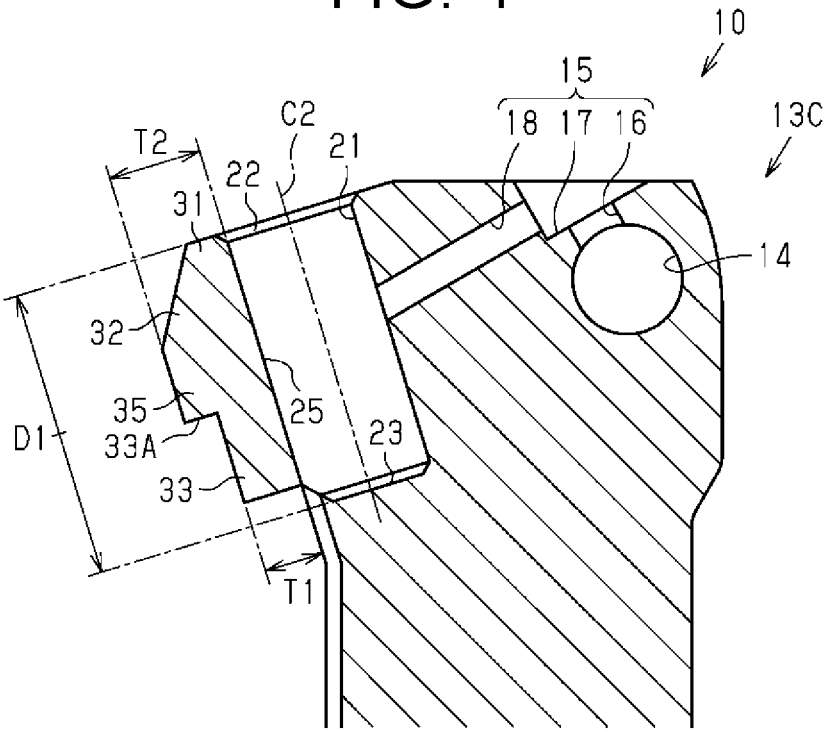
FIG. 4 is a sectional view of the HLA attachment portion in the cylinder head according to the embodiment.

A description will be provided on the first HLA attachment portion 13A to the eighth HLA attachment portion 13H with reference to FIG. 3 and FIG. 4. The following description will be provided on the third HLA attachment portion 13C and the fourth HLA attachment portion 13D as the pair of the HLA attachment portions. However, each of the HLA attachment portions 13A to 13H has the same configuration.

As illustrated in FIG. 3 and FIG. 4, the third HLA attachment portion 13C includes an HLA bore 21 in which the exhaust-side lash adjuster 47 is inserted. FIG. 4 illustrates the center axis C2 of the body of the exhaust-side lash adjuster 47 that is inserted in the HLA bore 21. The center axis C2 matches a center axis of the HLA bore 21. The HLA bore 21 is formed so as to fix the exhaust-side lash adjuster 47 in the inclined state as illustrated in FIG. 1.

As illustrated in FIG. 4, the third HLA attachment portion 13C is provided with a connection oil passage 15 that connects the HLA bore 21 and the main oil passage 14. The connection oil passage 15 includes a relay portion 17 that is opened to a top of the third HLA attachment portion 13C; a first passage 16 that provides communication between the main oil passage 14 and the relay portion 17; and a second passage 18 that provides communication between the relay portion 17 and the HLA bore 21. The second passage 18 is opened to an inner peripheral surface 25 defining the HLA bore 21. Note that the relay portion 17 is attached to an upper portion of the cylinder head 10 and communicates with an oil passage that is formed in a cam carrier that supports the intake-side camshaft 81 and the exhaust-side camshaft 83.

As illustrated in FIG. 3 and FIG. 4, the third HLA attachment portion 13C includes a side wall 31 that defines a radially outer portion of the HLA bore 21. The side wall 31 includes a first side wall portion 33 that is positioned close to a bottom 23 of the HLA bore 21; a second side wall portion 35 that is positioned closer to an opening 22 of the HLA bore 21 than the first side wall portion 33 is; and a chamfered portion 32 that is formed from the second side wall portion 35 toward an end on the side of the opening 22.

FIG. 4 illustrates a thickness T1 that is a radial thickness of the HLA bore 21 at the first side wall portion 33. A thickness T2 that is the radial thickness of the HLA bore 21 at the second side wall portion 35 is also illustrated in FIG. 4. The second side wall portion 35 is formed such that the thickness T2 of the second side wall portion 35 is greater than the thickness T1 of the first side wall portion 33. The side wall 31 is provided with a step portion 33A in which the thickness between the first side wall portion 33 and the second side wall portion 35 is changed in a stepped manner.

FIG. 4 illustrates an arrow that indicates a depth direction of the HLA bore 21. A center D1 indicates a center in the depth direction. In the side wall 31, at least a part of the second side wall portion 35 is included in an area that is closer to the opening 22 than the center D1 is. In addition, the side wall 31 is formed to have such a shape that a proportion of the first side wall portion 33 is greater than a proportion of the second side wall portion 35 in an area that is closer to the bottom 23 than the center D1 is, in the side wall 31. Thus, a volume of the side wall 31 in the area closer to the opening 22 than the center D1 is greater than the volume of the side wall 31 in the area closer to the bottom 23 than the center D1.

As illustrated in FIG. 1, the ignition plug 96 is attached to the cylinder head 10. As illustrated in FIG. 3, a plug attachment hole 38, in which the ignition plug 96 is inserted, is opened in the cylinder head 10. The plug attachment hole 38 is formed between the third HLA attachment portion 13C and the fourth HLA attachment portion 13D. That is, the plug attachment hole 38 is opened between the pair of the HLA attachment portions. The ignition plug 96 is disposed at a position between the pair of the HLA attachment portions.

As illustrated in FIG. 3, in the fourth HLA attachment portion 13D, a recess portion 37 is formed on the side of the third HLA attachment portion 13C. The recess portion 37 is formed by performing a machining process on the fourth HLA attachment portion 13D in accordance with a shape of the ignition plug 96 which is inserted in the plug attachment hole 38. That is, the fourth HLA attachment portion 13D is provided with the recess portion 37 that is recessed in accordance with the shape of the ignition plug 96. Although not illustrated, similar to the fourth HLA attachment portion 13D, the third HLA attachment portion 13C is provided with the recess portion 37 on the side of the fourth HLA attachment portion 13D. That is, in the pair of the HLA attachment portions, the recess portions 37 are formed on surfaces facing each other.

In the case where the load is applied to the exhaust-side lash adjuster 47 at the time when the exhaust valve 48 is opened, stress is generated around the HLA bore 21 in which the exhaust-side lash adjuster 47 is inserted. In the case where a stress amplitude resulting from repeated opening-closing of the exhaust valve 48 is large, a portion around the HLA bore 21 may be deformed. Thus, the thickness T2 of the second side wall portion 35 is set to a thickness that can ensure strength required in the portion around the HLA bore 21.

The thickness T2 of the second side wall portion 35 is greater than the thickness T1 of the first side wall portion 33 in the side wall 31 excluding the recess portion 37, the side wall 31 defining the HLA bore 21. In addition, since the recess portion 37 is formed in the fourth HLA attachment portion 13D, the stress at the time when a specified magnitude of the load is applied tends to be greater at a portion where the recess portion 37 is formed in the fourth HLA attachment portion 13D, that is, at the portion on the side of the third HLA attachment portion 13C than at a portion where the recess portion 37 is not formed, that is, the portion on the side of the fifth HLA attachment portion 13E. Accordingly, based on the portion where the recess portion 37 is formed (i.e., with the use of the portion where the recess portion 37 is formed as a reference), the thickness T2 of the second side wall portion 35 is set to a thickness that can ensure the strength of the side wall 31 required to endure the stress amplitude resulting from the repeated opening-closing of the exhaust valve 48. The thickness T2 of the second side wall portion 35 is set to be constant at the portion where the recess portion 37 is formed and at the portion where the recess portion 37 is not formed.

A description will be provided on operation and effects of this embodiment. In each of the HLA attachment portions 13A to 13H, the side wall 31 is reinforced by providing the second side wall portion 35 where the thickness of the side wall 31 defining the HLA bore 21 is partially increased. In the side wall 31, at least a part of the second side wall portion 35 that is thicker than the first side wall portion 33 is included in the area that is closer to the opening 22 than the center D1 of the HLA bore 21 in the depth direction is. Thus, it is possible to ensure the required strength of the portion closer to the opening 22 than the center D1 of the HLA bore 21 in the depth direction is, that is, the portion where the stress, which is generated by the load applied to the exhaust-side lash adjuster 47 at the time when the exhaust valve 48 is opened, is likely to act. Thus, in the cylinder head 10 in which the main oil passage 14 extending in the axial direction of the exhaust-side camshaft 83 is positioned away from the HLA bore 21, it is possible to secure the strength of the portion around the HLA bore 21 by reinforcing the side wall 31 defining the HLA bore 21 with the use of the second side wall portion 35.

Each of the HLA attachment portions 13A to 13H is provided with the recess portion 37. However, the thickness of the second side wall portion 35 is greater than the thickness of the first side wall portion 33 in the side wall 31 excluding the recess portion 37, the side wall 31 defining the HLA bore 21. In addition, the thickness T2 of the second side wall portion 35 is set with the use of the stress as the reference, the stress acting on the portion where the recess portion 37 is formed at the time when the exhaust valve 48 is opened. Thus, in each of the HLA attachment portions 13A to 13H provided with the recess portion 37, it is possible to ensure the required strength of the portion around the HLA bore 21.

In each of the HLA attachment portions 13A to 13H, while the thickness of the side wall 31 is increased by the second side wall portion 35, the first side wall portion 33, which is thinner than the second side wall portion 35, is provided at the portion close to (i.e., the portion on the side of) the bottom 23 of the HLA bore 21 where the stress generated by the load applied to the exhaust-side lash adjuster 47 is less likely to act. In addition, in the side wall 31 defining the HLA bore 21, in the area that is closer to the bottom 23 than the center D1 of the HLA bore 21 in the depth direction is, the proportion of the first side wall portion 33 is greater than the proportion of the second side wall portion 35, and thus the proportion of the second side wall portion 35, which is thicker than the first side wall portion 33, is small. Thickening of the entire side wall 31 defining the HLA bore 21 leads to an increase in the weight thereof. Meanwhile, in the cylinder head 10 that includes each of the HLA attachment portions 13A to 13H, the portion that requires strength is thickened. Thus, it is possible to reduce the weight increase.

That is, in the cylinder head 10 that includes each of the HLA attachment portions 13A to 13H, it is possible to reduce the weight increase while ensuring the strength for supporting the exhaust-side lash adjuster 47 against the stress, which is generated by the load applied to the exhaust-side lash adjuster 47.

In the cylinder head 10, the required strength of the portion around the HLA bore 21 is ensured by the second side wall portion 35 where the thickness of the side wall 31 is increased. Thus, in the cylinder head 10, it is also possible to ensure the required strength of the portion around the HLA bore 21 in the internal combustion engine of a center injection type that has a restriction on the arrangement of the main oil passage 14 extending in the axial direction of the exhaust-side camshaft 83.

Each of the HLA attachment portions 13A to 13H may be regarded as the hydraulic lash adjuster attachment portion in which "a side wall defines a radially outer portion of the hydraulic lash adjuster bore in the hydraulic lash adjuster attachment portion, the side wall includes a first side wall portion and a second side wall portion that is positioned closer to an opening of the hydraulic lash adjuster bore than the first side wall portion is, and a thickness of the second side wall portion is greater than a thickness of the first side wall portion".

The embodiment can be modified and implemented as follows. The embodiment and any of the following modified examples may be combined as long as they do not technically contradict with each other. In the above embodiment, the recess portion 37 is provided in each of the HLA attachment portions 13A to 13H. However, the recess portion 37 is not an essential component. The recess portion 37 may not be formed as long as each of the HLA attachment portions 13A to 13H without the recess portion 37 does not interfere with the ignition plug 96.

In the above embodiment, the internal combustion engine of the center injection type is described as an example. However, the position where the direct injection injector 95 is provided is not limited thereto. Even in the case where the internal combustion engine is not the center injection type engine, it is difficult to ensure the sufficient strength of the side wall 31 defining the HLA bore 21 when the main oil passage 14, which extends in the axial direction of the exhaust-side camshaft 83, is formed away from the HLA bore 21. That is, in the case where the main oil passage 14 is positioned away from the HLA bore 21, it is effective to thicken the side wall 31 by the second side wall portion 35.

In the above embodiment, in the side wall 31 defining the HLA bore 21, in the area that is closer to the bottom 23 than the center D1 of the HLA bore 21 in the depth direction is, the proportion of the first side wall portion 33 is greater than the proportion of the second side wall portion 35. However, the disclosure is not limited to this structure. Any structure may be employed as long as the first side wall portion 33 is provided closer to the bottom 23 than the second side wall portion 35 is, in the side wall 31. In the case where the first side wall portion 33 of the side wall 31, which is thinner than the second side wall portion 35 of the side wall 31, is provided, it is possible to obtain an effect that the weight increase is reduced as compared to the case where the thickness of the entire side wall 31 defining the HLA bore 21 is set to be the same as the thickness T2 of the second side wall portion 35.

In the above embodiment, in the side wall 31 defining the HLA bore 21, at least a part of the second side wall portion 35 that is thicker than the first side wall portion 33 is included in the area that is closer to the opening 22 than the center D1 of the HLA bore 21 in the depth direction is. The area where the side wall 31 is thickened by the second side wall portion 35 may be set according to the stress generated by the load applied to the exhaust-side lash adjuster 47.

In the above embodiment, the third HLA attachment portion 13C, in which the chamfered portion 32 is provided in the side wall 31 defining the HLA bore 21, is described as an example. Instead of this configuration, the cylinder head may include an HLA attachment portion 113 illustrated in FIG. 5.

Figure 5:
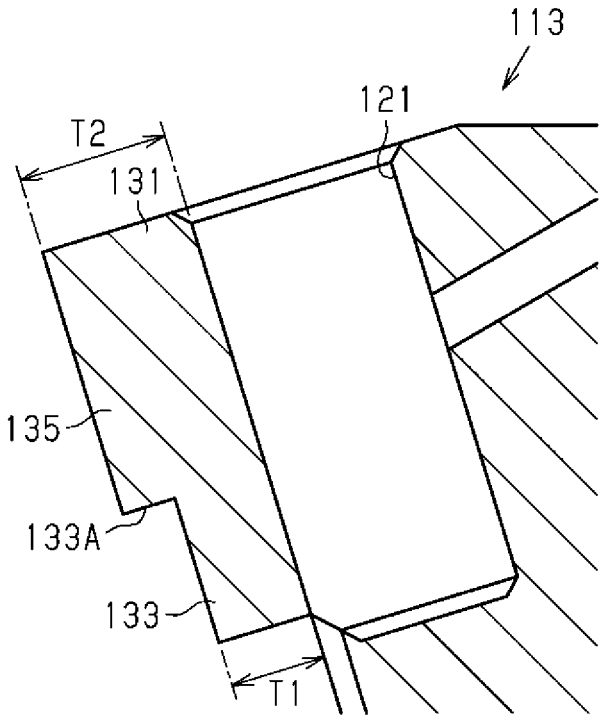
FIG. 5 is a sectional view of an HLA attachment portion in a modified example of the cylinder head.

FIG. 5 illustrates a sectional structure of the HLA attachment portion 113 that is provided with an HLA bore 121. In a side wall 131 defining the HLA bore 121, a first side wall portion 133 having the thickness T1 is provided on the bottom side of the HLA bore 121, that is, the first side wall portion 133 is provided close to the bottom of the HLA bore 121. In the side wall 131, a second side wall portion 135 having the thickness T2 is provided closer to an opening of the HLA bore 121 than the first side wall portion 133 is. Similarly to the above embodiment, the thickness T2 is set to the thickness that can ensure the strength required in the portion around the HLA bore 121. The second side wall portion 135 is provided to extend to an end of the side wall 131, the end being located on the side of the opening of the HLA bore 121 (i.e., the end being located close to the opening of the HLA bore 121). In the HLA attachment portion 113 as well, effects similar to those of the above embodiment can be obtained. That is, the chamfered portion 32 provided in the third HLA attachment portion 13C is not the essential component.

In the above embodiment, the third HLA attachment portion 13C, which is provided with the step portion 33A between the first side wall portion 33 and the second side wall portion 35, is described as an example. As in the HLA attachment portion 113 illustrated in FIG. 5, an intermediate portion 133A may be provided instead of the step portion 33A. The intermediate portion 133A may have a sectional shape having a curved outline such that the thickness of the intermediate portion 133A is gradually increased from the first side wall portion 133-side toward the second side wall portion 135-side. The intermediate portion 133A may have a sectional shape having a linear outline.

In the above embodiment, the thickness of the thickest portion in the side wall 31 of the HLA bore 21 is set to the thickness T2 of the second side wall portion 35. As in an HLA attachment portion 213 illustrated in FIG. 6, a thickness of a side wall 231 may be greater than the thickness T2.

Figure 6:
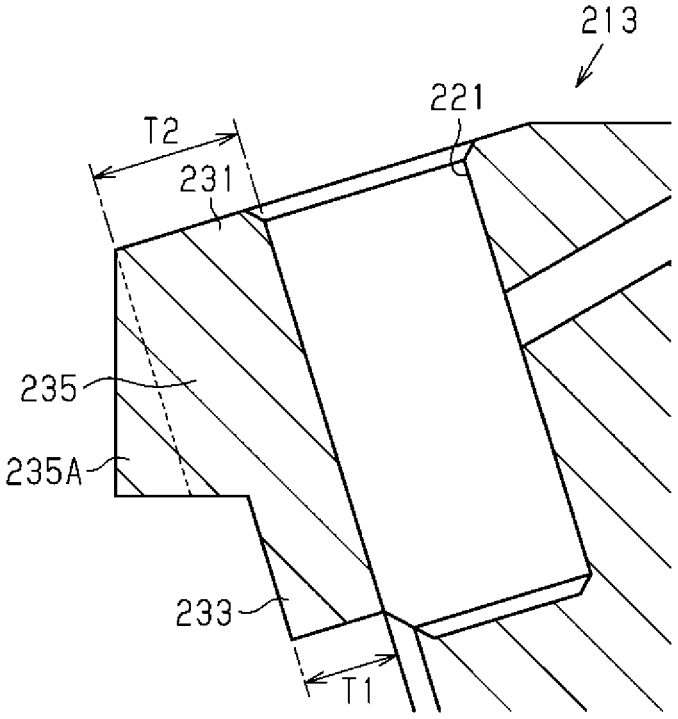
FIG. 6 is a sectional view of an HLA attachment portion in another modified example of the cylinder head.

FIG. 6 illustrates a sectional structure of the HLA attachment portion 213 that is provided with an HLA bore 221. In the side wall 231 defining the HLA bore 221, a first side wall portion 233 having the thickness T1 is provided close to the bottom of the HLA bore 221. In the side wall 231, a second side wall portion 235 is provided closer to the opening of the HLA bore 221 than the first side wall portion 233 is. The second side wall portion 235 has the thickness T2 at an end on the side of the opening of the HLA bore 221 (i.e., at the end close to the opening of the HLA bore 221). Similarly to the above embodiment, the thickness T2 is set to the thickness that can ensure the strength required in the portion around the HLA bore 221. The second side wall portion 235 has a thickened portion 235A in which the thickness of the side wall 231 is increased toward the bottom of the HLA bore 221. In the HLA attachment portion 213 as well, it is possible to obtain the effect of ensuring the strength required in the portion around the HLA bore 221.

The thickness T2 of the second side wall portion 35 may be changed. The thickness T2 of the second side wall portion 35 may be set to the thickness that can ensure the required strength, according to a magnitude of the stress that may act on the side wall 31 defining the HLA bore 21.

In the above embodiment, each of the HLA attachment portions 13A to 13H, which includes the connection oil passage 15 connecting the main oil passage 14 and the HLA bore 21, is described as an example. The shape of the connection oil passage 15 illustrated in FIG. 4 is one example. The connection oil passage 15 may have any shape as long as the connection oil passage 15 connects the main oil passage 14 and the HLA bore 21 and the oil can be supplied to the exhaust-side lash adjuster 47 through the connection oil passage 15.

The number of the HLA attachment portions provided in the cylinder head 10 is changed according to the number of the cylinders of the internal combustion engine including the cylinder head 10. In the above embodiment, in each of the HLA attachment portions 13A to 13H provided with the HLA bore 21 in which the exhaust-side lash adjuster 47 is inserted, the second side wall portion 35 of the side wall 31, which is thicker than the first side wall portion 33 of the side wall 31, is provided closer to the opening 22 than the first side wall portion 33 is. That is, the exhaust-side HLA attachment portions are described as examples. The configuration in which the side wall 31 is thickened by the second side wall portion 35 can also be applied to the intake-side HLA attachment portions 19A to 19H each of which supports the intake-side lash adjuster 43.

What is claimed is:

1. A cylinder head configured to be provided in an internal combustion engine that includes at least one valve drive mechanism including a hydraulic lash adjuster and a rocker arm, each of the at least one valve drive mechanism being configured to transmit rotation of a camshaft to drive an intake valve or an exhaust valve, the cylinder head comprising:

a hydraulic lash adjuster attachment portion provided with a hydraulic lash adjuster bore in which the hydraulic lash adjuster is inserted;

a main oil passage through which oil flows, the main oil passage extending in an axial direction of the camshaft and being positioned away from the hydraulic lash adjuster bore in a direction perpendicular to the axial direction of the camshaft;

a connection oil passage which connects the hydraulic lash adjuster bore and the main oil passage, and through which the oil is supplied to the hydraulic lash adjuster; and a side wall that defines a radially outer portion of the hydraulic lash adjuster bore in the hydraulic lash adjuster attachment portion, the side wall including a first side wall portion and a second side wall portion that is positioned closer to an opening of the hydraulic lash adjuster bore than the first side wall portion is, and a thickness of the second side wall portion being greater than a thickness of the first side wall portion, wherein in the side wall defining the hydraulic lash adjuster bore, at least a part of the second side wall portion that is thicker than the first side wall portion is included in an area that is closer to the opening than a center of the hydraulic lash adjuster bore in a depth direction is.

2. The cylinder head according to claim 1, wherein in the side wall defining the hydraulic lash adjuster bore, in an area that is closer to a bottom of the hydraulic lash adjuster bore than the center of the hydraulic lash adjuster bore in the depth direction is, a proportion of the first side wall portion is greater than a proportion of the second side wall portion.

3. The cylinder head according to claim 1, wherein an ignition plug and a direct injection injector are disposed between the intake valve and the exhaust valve such that an injection hole of the direct injection injector is positioned in a central portion of a combustion chamber.

4. The cylinder head according to claim 1, wherein:

the cylinder head is configured to be provided in the internal combustion engine in which two exhaust valves are provided in each combustion chamber, and the valve drive mechanisms are respectively provided to drive the exhaust valves;

an ignition plug is disposed at a position between the hydraulic lash adjuster attachment portions corresponding to the hydraulic lash adjusters provided in the valve drive mechanisms;

each of the hydraulic lash adjuster attachment portions is provided with a recess portion that is recessed in accordance with a shape of the ignition plug; and the thickness of the second side wall portion is greater than the thickness of the first side wall portion in the side wall excluding the recess portion.

5. The cylinder head according to claim 1, wherein in the side wall includes a step portion in which the thickness between the first side wall portion and the second side wall portion changes.

6. A cylinder head configured to be provided in an internal combustion engine that includes at least one valve drive mechanism including a hydraulic lash adjuster and a rocker arm, each of the at least one valve drive mechanism being configured to transmit rotation of a camshaft to drive an intake valve or an exhaust valve, the cylinder head comprising:

a hydraulic lash adjuster attachment portion provided with a hydraulic lash adjuster bore in which the hydraulic lash adjuster is inserted;

a main oil passage through which oil flows, the main oil passage extending in an axial direction of the camshaft and being positioned away from the hydraulic lash adjuster bore in a direction perpendicular to the axial direction of the camshaft;

a connection oil passage which connects the hydraulic lash adjuster bore and the main oil passage, and through which the oil is supplied to the hydraulic lash adjuster; and a side wall that defines a radially outer portion of the hydraulic lash adjuster bore in the hydraulic lash adjuster attachment portion, the side wall including a first side wall portion and a second side wall portion that is positioned closer to an opening of the hydraulic lash adjuster bore than the first side wall portion is, and a thickness of the second side wall portion being greater than a thickness of the first side wall portion, wherein:

the cylinder head is configured to be provided in the internal combustion engine in which two exhaust valves are provided in each combustion chamber, and the valve drive mechanisms are respectively provided to drive the exhaust valves;

an ignition plug is disposed at a position between the hydraulic lash adjuster attachment portions corresponding to the hydraulic lash adjusters provided in the valve drive mechanisms;

each of the hydraulic lash adjuster attachment portions is provided with a recess portion that is recessed in accordance with a shape of the ignition plug; and the thickness of the second side wall portion is greater than the thickness of the first side wall portion in the side wall excluding the recess portion.

* * * * *